US009162237B2

(12) United States Patent
Huffington et al.

(10) Patent No.: US 9,162,237 B2
(45) Date of Patent: Oct. 20, 2015

(54) HAND TIGHTENED SHOWERHEAD

(71) Applicant: Masco Corporation of Indiana, Indianapolis, IN (US)

(72) Inventors: Todd Andrew Huffington, Avon, IN (US); Anthony G. Spangler, Indianapolis, IN (US)

(73) Assignee: Delta Faucet Company, Indianapolis, IN (US)

( * ) Notice: Subject to any disclaimer, the term of this patent is extended or adjusted under 35 U.S.C. 154(b) by 0 days.

(21) Appl. No.: 14/087,610

(22) Filed: Nov. 22, 2013

(65) Prior Publication Data

US 2014/0151467 A1 Jun. 5, 2014

Related U.S. Application Data

(60) Provisional application No. 61/732,648, filed on Dec. 3, 2012.

(51) Int. Cl.

| | |
|---|---|
| ***B05B 1/18*** | (2006.01) |
| ***B05B 1/04*** | (2006.01) |
| ***B05B 1/08*** | (2006.01) |
| ***B05B 15/06*** | (2006.01) |

(52) U.S. Cl.

CPC . *B05B 1/185* (2013.01); *B05B 1/04* (2013.01); *B05B 1/08* (2013.01); *B05B 15/065* (2013.01)

(58) Field of Classification Search

CPC ..... B05B 1/18; B05B 1/185; B05B 1/04; B05B 1/08; B05B 15/065

USPC ..... 239/587.1, 587.3, 587.4, 600, 548; 285/261, 262, 264, 268, 271, 121.7

See application file for complete search history.

(56) References Cited

U.S. PATENT DOCUMENTS

| | | | | |
|---|---|---|---|---|
| 1,724,161 | A * | 8/1929 | Wuesthoff | 239/548 |
| 3,887,136 | A * | 6/1975 | Anderson | 239/460 |
| 5,697,557 | A | 12/1997 | Blessing et al. | |
| 6,024,303 | A * | 2/2000 | Oremland | 239/587.4 |
| 6,170,765 | B1 | 1/2001 | Gil et al. | |
| 6,354,518 | B1 | 3/2002 | Gil et al. | |
| 7,472,846 | B2 * | 1/2009 | Thomas et al. | 239/587.4 |
| 2006/0283986 | A1 * | 12/2006 | Chung | 239/552 |
| 2011/0186653 | A1 * | 8/2011 | Cai et al. | 239/548 |
| 2011/0272492 | A1 * | 11/2011 | Simpson | 239/462 |
| 2012/0217321 | A1 | 8/2012 | Lin | |
| 2013/0032647 | A1 | 2/2013 | Zhou et al. | |

FOREIGN PATENT DOCUMENTS

| | | |
|---|---|---|
| CN | 201482602 | 5/2010 |
| WO | WO 2012/050894 | 4/2012 |

* cited by examiner

*Primary Examiner* — Len Tran
*Assistant Examiner* — Cody Lieuwen
(74) *Attorney, Agent, or Firm* — Faegre Baker Daniels LLP

(57) ABSTRACT

A showerhead including a fluid connector configured to be threadedly coupled to a shower arm, and an outer shell receiving the fluid connector. A rotational stop or drive member is operably coupled between the fluid connector and the outer shell and is configured to limit relative rotation between the fluid connector and the outer shell.

11 Claims, 12 Drawing Sheets

HAND TIGHTENED SHOWERHEAD

CROSS-REFERENCE TO RELATED APPLICATION

The present application claims priority to U.S. Provisional Application Ser. No. 61/732,648, filed Dec. 3, 2012, the disclosure of which is expressly incorporated herein by reference.

BACKGROUND AND SUMMARY OF THE INVENTION

The present invention relates generally to a showerhead and, more particularly, to a showerhead including a housing pivotable about a fluid coupling and configured to be hand tightened to a shower arm.

According to an illustrative embodiment of the present disclosure, a showerhead includes a fluid connector hidden by an outer shell when installed on a standard shower arm. The showerhead may be hand tightened onto the shower arm. In one illustrative embodiment, drive features are provided on the showerhead that facilitate threading onto the shower arm while maintaining adjustability after installation. In another illustrative embodiment, a drive tool is removably coupled to the showerhead during installation onto the shower arm and then disposed of thereafter.

According to an illustrative embodiment of the present disclosure, a showerhead includes a fluid connector having a ball with an outlet and a stem with an inlet. A fluid passageway extends along a longitudinal axis between the inlet and the outlet. An inner housing defines a ball joint socket receiving the ball for pivoting movement about a pair of orthogonal axes. An outer shell includes a side wall extending between an inlet end and an outlet end, and an opening defined at the inlet end, wherein the stem of the fluid connector is recessed within the opening of the outer shell. A rotational stop is operably coupled between the fluid connector and the outer shell. The rotational stop is configured to limit relative rotation about the longitudinal axis between the fluid connector and the outer shell.

According to another illustrative embodiment of the present disclosure, a showerhead includes a fluid connector having a ball and a stem, the stem including threads to couple with threads on a shower arm. A ball joint socket receives the ball for pivoting movement about a pair of orthogonal axes. An outer shell receives the ball joint socket. A rotational stop includes an inner engagement member supported by the stem of the fluid connector, and an outer engagement member supported by the outer shell. The inner engagement member is configured to contact the outer engagement member to limit relative rotation between the fluid connector and the outer shell.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
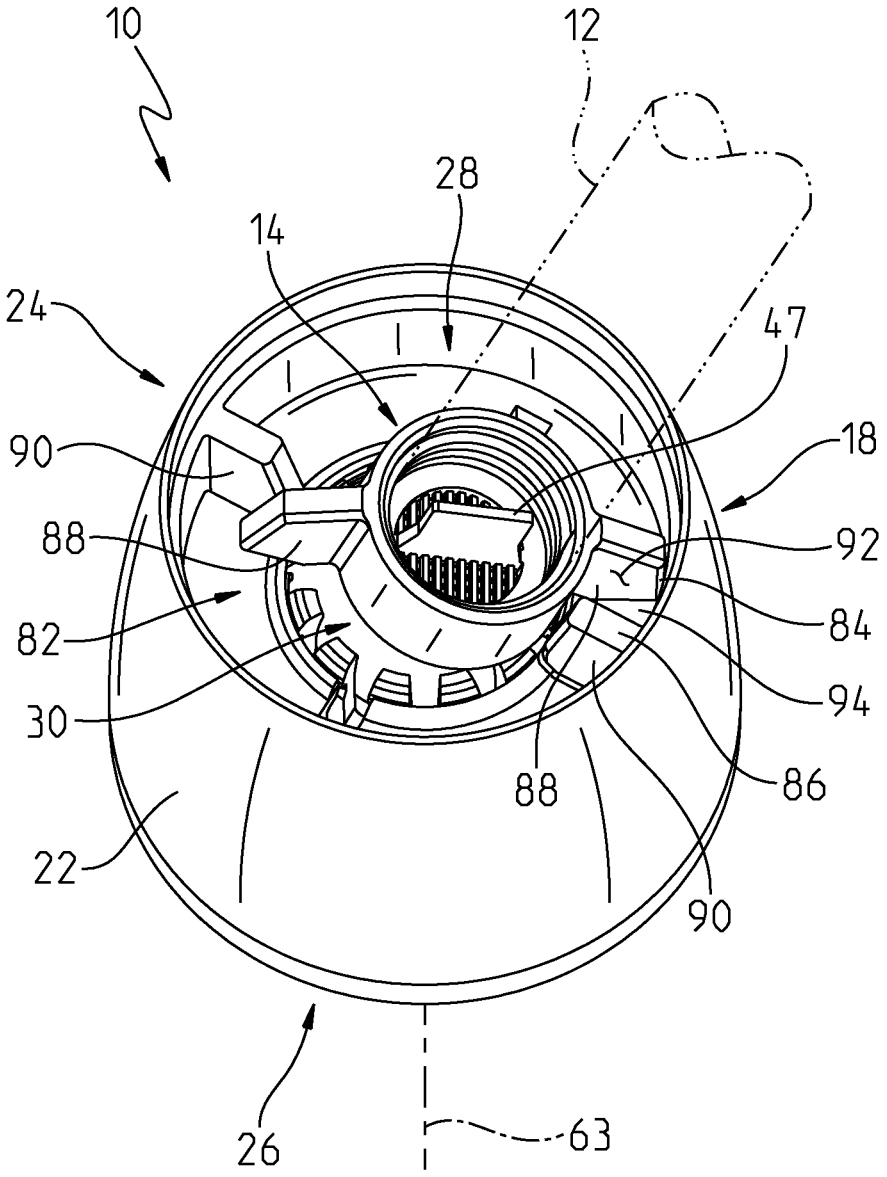
FIG. 1 is a rear perspective view of an illustrative showerhead of the present disclosure, showing the rotational stop in a tightening mode.
Figure 2:
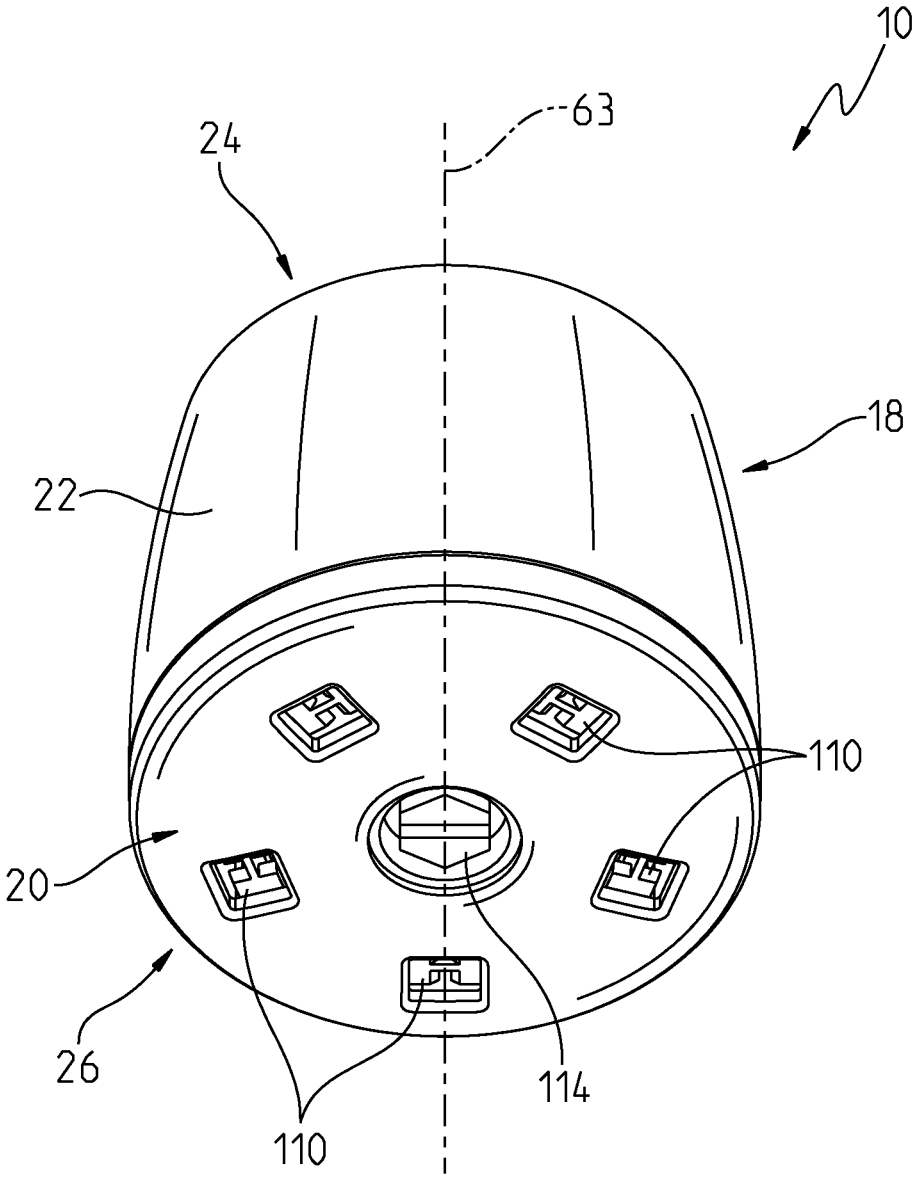
FIG. 2 is a front perspective view of the showerhead of FIG. 1.

The embodiments of the invention described herein are not intended to be exhaustive or to limit the invention to precise forms disclosed. Rather, the embodiments elected for description have been chosen to enable one skilled in the art to practice the invention.

Referring initially to FIGS. 1-4 and 9, an illustrative showerhead 10 is configured to be fluidly coupled to a conduit, such as a shower arm 12 extending from a shower wall (not shown). More particularly, the showerhead 10 is of the type pivotably adjustable by a user relative to the shower arm 12 about at least a pair of orthogonal axes.

The illustrative showerhead 10 is shown as including a fluid coupling 14, an inner housing or receiver 16, an outer housing or shell 18, and a sprayface 20. The shell 18 illustratively includes a side wall 22 extending between a first or inlet end 24 and a second or outlet end 26. The fluid coupling 14 is supported within a recess or opening 28 at the inlet end 24 of the shell 18, while the sprayface 20 is supported at the outlet end 26 of the shell 18.

The illustrative fluid coupling 14 includes a fluid connector 30 having a ball 32 and a stem 34. A fluid passageway 36 extends along a longitudinal axis 37 within the ball 32 and the stem 34 and provides fluid communication from the shower arm 12 to the sprayface 20. The stem 34 includes an open first or inlet end 38, and the ball 32 includes a second or outlet end 40. Illustratively, internal threads 42 are supported by the stem 34. The ball 32 and the stem 34 are illustratively formed of a polymer (such as polyoxymethylene (PLM), a glass-filled polypropylene, or a glass-filled nylon) in a molding operation to form integral fluid connector 30.

Figure 9:
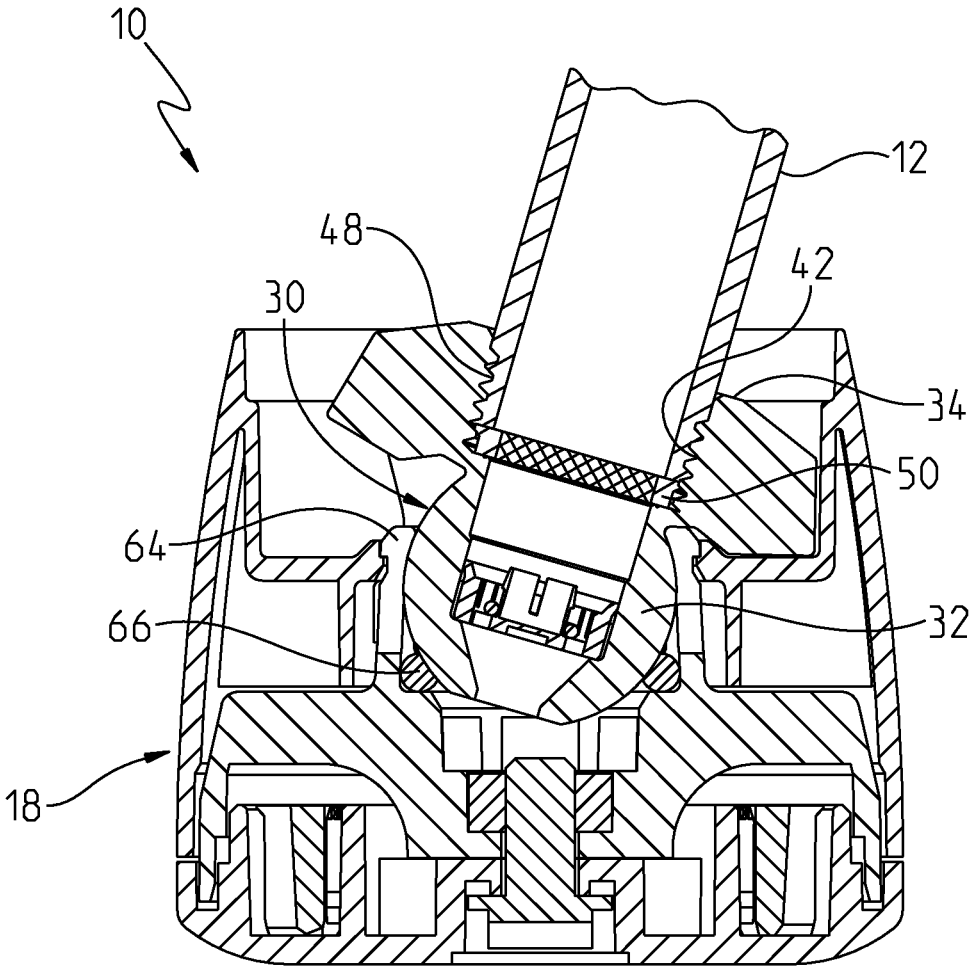
FIG. 9 is a cross-sectional view of the showerhead of FIG. 1, showing the showerhead of FIG. 1 attached to a shower arm.

A flow regulator 44 including an o-ring seal or gasket 46 is illustratively received within the passageway 36 of the stem 34. A plastic screen or filter 47 may also be positioned within the passageway 36 of the stem 34. The shower arm 12 may be of conventional design as configured to be supported by a vertical shower wall (not shown) and including external threads 48 configured to threadably couple with the internal threads 42 of the stem 34. An elastomeric seal or gasket 50 (which may form part of the screen 47) may be positioned intermediate the shower arm 12 and the stem 34 to provide a face seal between the stem 34 and the shower arm 12 (FIG. 9).

Figure 5:
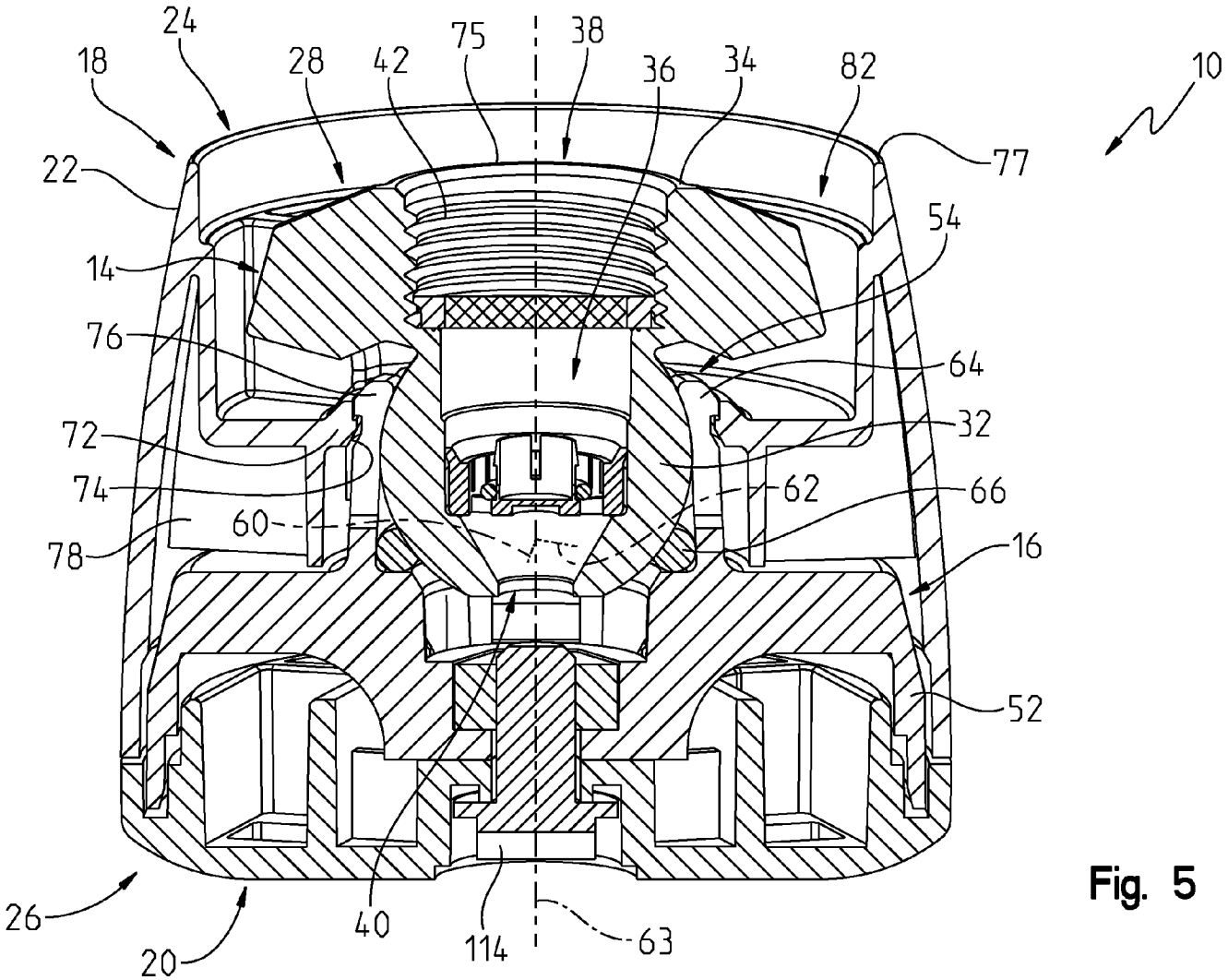
FIG. 5 is a perspective view in longitudinal cross-section of the showerhead of FIG. 1.
Figure 7:
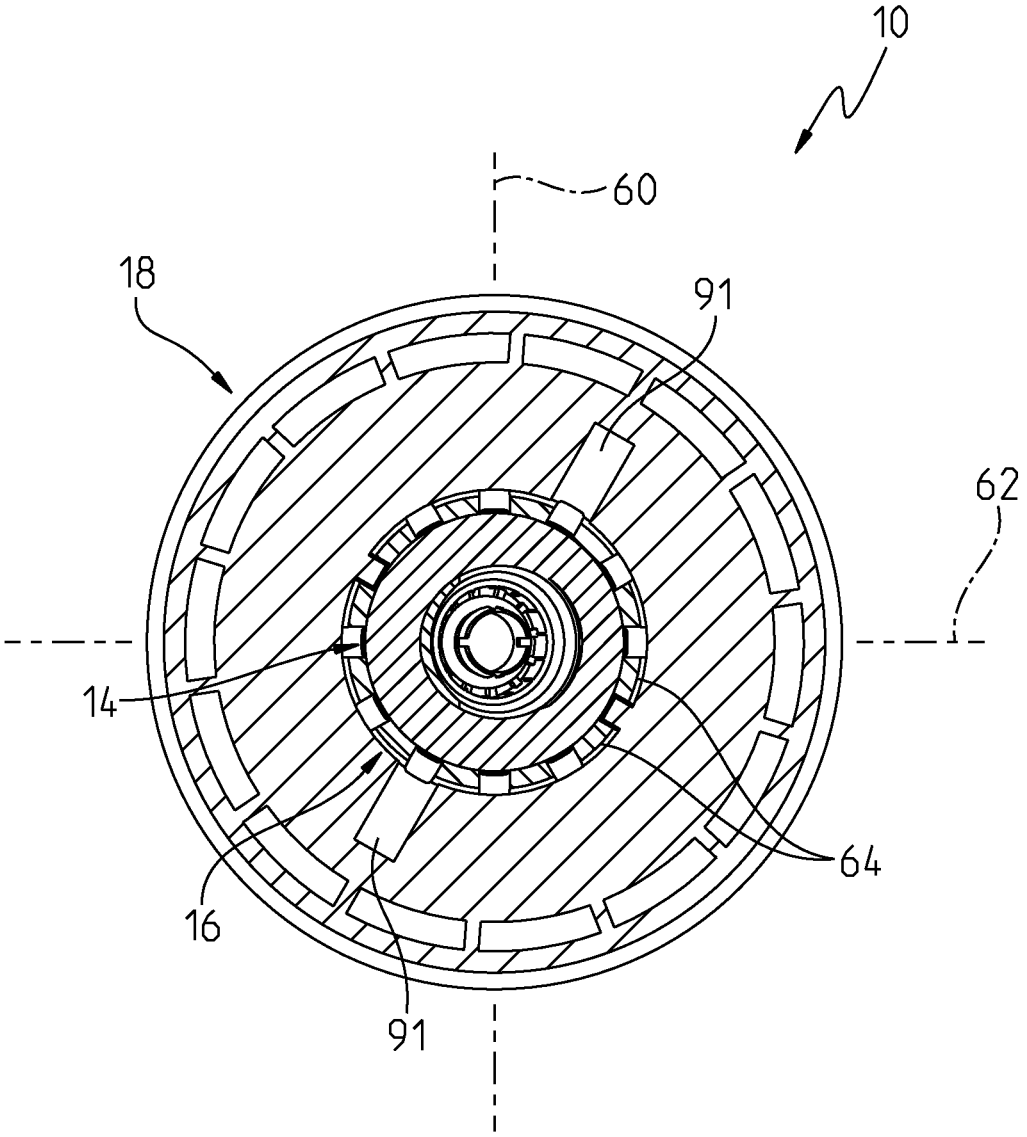
FIG. 7 is a cross-sectional view taken along line 7-7 of FIG. 6.

The shower ball 32 is operably coupled to the receiver 16, which includes a lower base 52 and an upper coupler 54. More particularly, the ball 32 is pivotably coupled to the upper coupler 54 of the receiver 16 such that it is recessed within the opening 28 at the inlet end 24 of the shell 18. The ball 32 is supported to permit pivoting movement of the receiver 16 about orthogonal axis 60 and 62. The orthogonal axes 60 and 62 extend perpendicular to a longitudinal axis 63 of the shell 18 (FIGS. 5 and 7). The upper coupler 54 of the receiver 16 illustratively includes a plurality of circumferentially spaced resilient arms 64 configured to capture the ball 32 (snap fit) and prevent axial movement while permitting movement about orthogonal axes 60 and 62. A seal, such as an o-ring 66, seals against the ball 32 and the receiver 16.

The shell 18 illustratively includes arcuate outer side wall 22 extending between the inlet and outlet ends 24 and 26 along longitudinal axis 63. An inner wall or backing shoulder 72 is positioned inwardly from the outer side wall 22 and reinforces the resilient arms 64 of the receiver 16. As shown in FIG. 5, the shoulder 72 includes a lip 74 configured to operate in locking engagement of tabs 76 formed in the upper ends of the arms 64. The outer shell 18 may be formed of a polymer, such as acrylonitrile butadiene styrene (ABS), with an outer surface being chrome plated. As shown in FIG. 5, the fluid connector 30 is illustratively recessed within opening 28 of shell 18. More particularly, a top surface 75 of the stem 34 is positioned below a top surface 77 of the shell 18.

Figure 3:
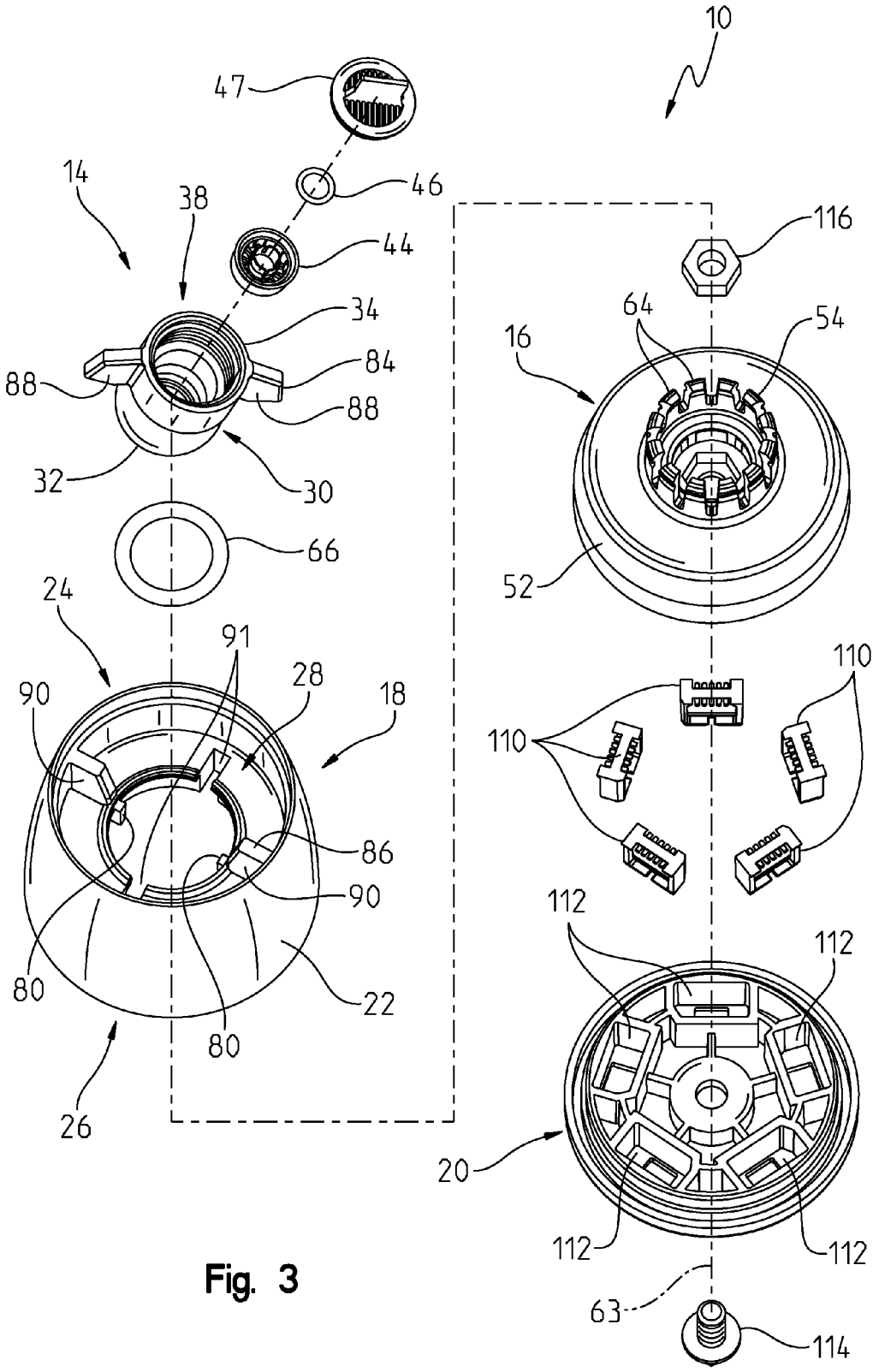
FIG. 3 is a rear exploded perspective view of the showerhead of FIG. 1.
Figure 4:
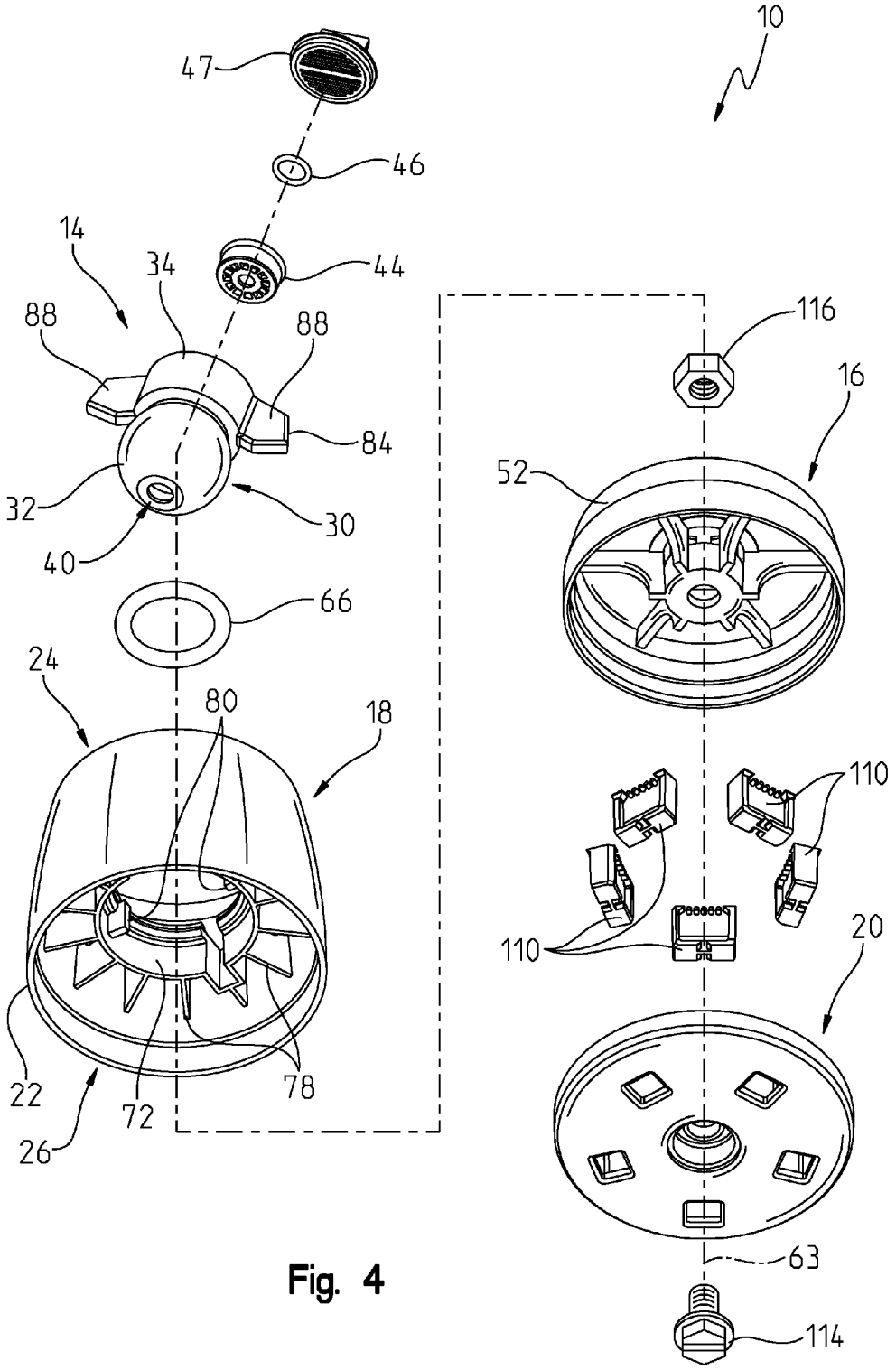
FIG. 4 is a front exploded perspective view of the showerhead of FIG. 1.
Figure 10:
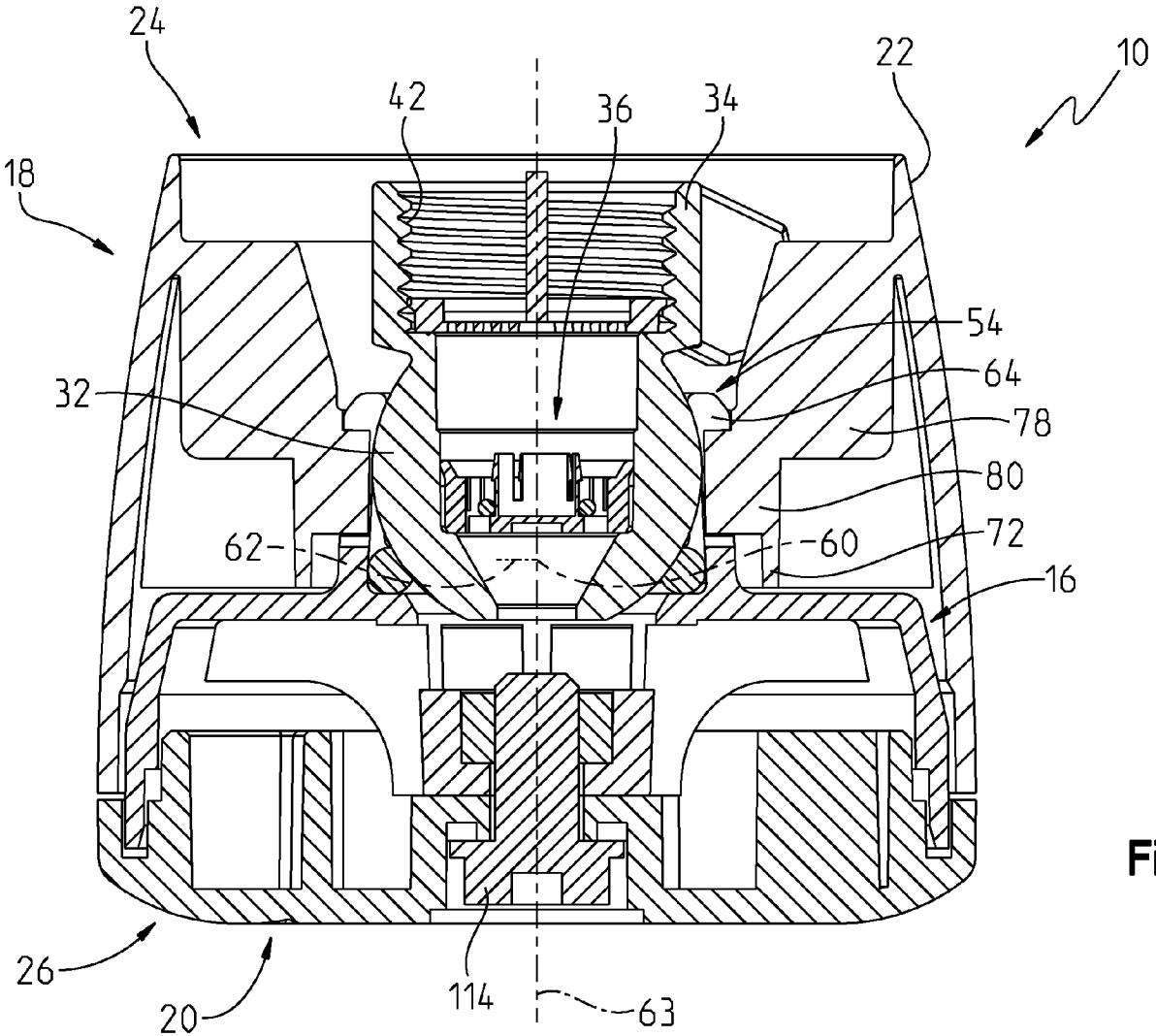
FIG. 10 is a cross-sectional view showing interaction between the shell and the inner housing.

With reference to FIGS. 3, 4, and 10, a plurality of strengthening webs 78 illustratively extend between the outer side wall 22 and the inner backing shoulder 72 of the shell 18. Referring to FIGS. 3-5, a pair of diametrically opposed ribs 80 are illustratively supported by the backing shoulder 72 and fit between adjacent arms 64 of the receiver 16. The positioning of the ribs 80 and the arms 64 prevents rotation of the shell 18 with respect to the receiver 16 about the longitudinal axis 63.

A drive member or rotational stop 82 is operably coupled between the fluid connector 30 and the outer shell 18. The rotational stop 82 is configured to limit relative rotation about the longitudinal axis 37 between the fluid connector 30 and the outer shell 18, thereby causing rotation of the outer shell 18 to result in rotation of the fluid connector 30. In other words, the rotational stop 82 acts as a drive coupling between the outer shell 18 and the fluid connector 30 to allow a user to couple and uncouple the showerhead 10 to a shower arm 12.

The rotational stop 82 illustratively includes an inner engagement member 84 supported by the fluid connector 30, and an outer engagement member 86 supported by the outer shell 18. The inner engagement member 84 illustratively includes a pair of diametrically opposed tabs or blades 88 extending radially outwardly from the stem 34 of the fluid connector 30. The outer engagement member 86 illustratively includes a pair of cooperating ribs 90 extending radially inwardly from the sidewall 70 of the outer shell 18 into the opening 28. As may be appreciated, the blades 88 and the ribs 90 provide for limited rotational movement between the outer shell 18 and the fluid connector 30. A pair of diametrically opposed slots 91 are formed within the shell 18 and are configured to permit passage of the blades 88 therethrough during assembly of the shell 18 to the receiver 16.

FIG. 1 illustrates the rotational stop 82 in a first or tightening mode of operation wherein the outer shell 18 has been rotated counterclockwise such that a first surface 92 of at least one of the blades 88 engages a first surface 94 of at least one of the ribs 90. Further counterclockwise rotation of the outer shell 18 will cause the stem 34 of the fluid connector 30 to also rotate in a counterclockwise direction. Such counterclockwise rotation of the stem 34 relative to the shower arm 12 will cause threading of the showerhead 10 onto the shower arm 12.

Figure 8:
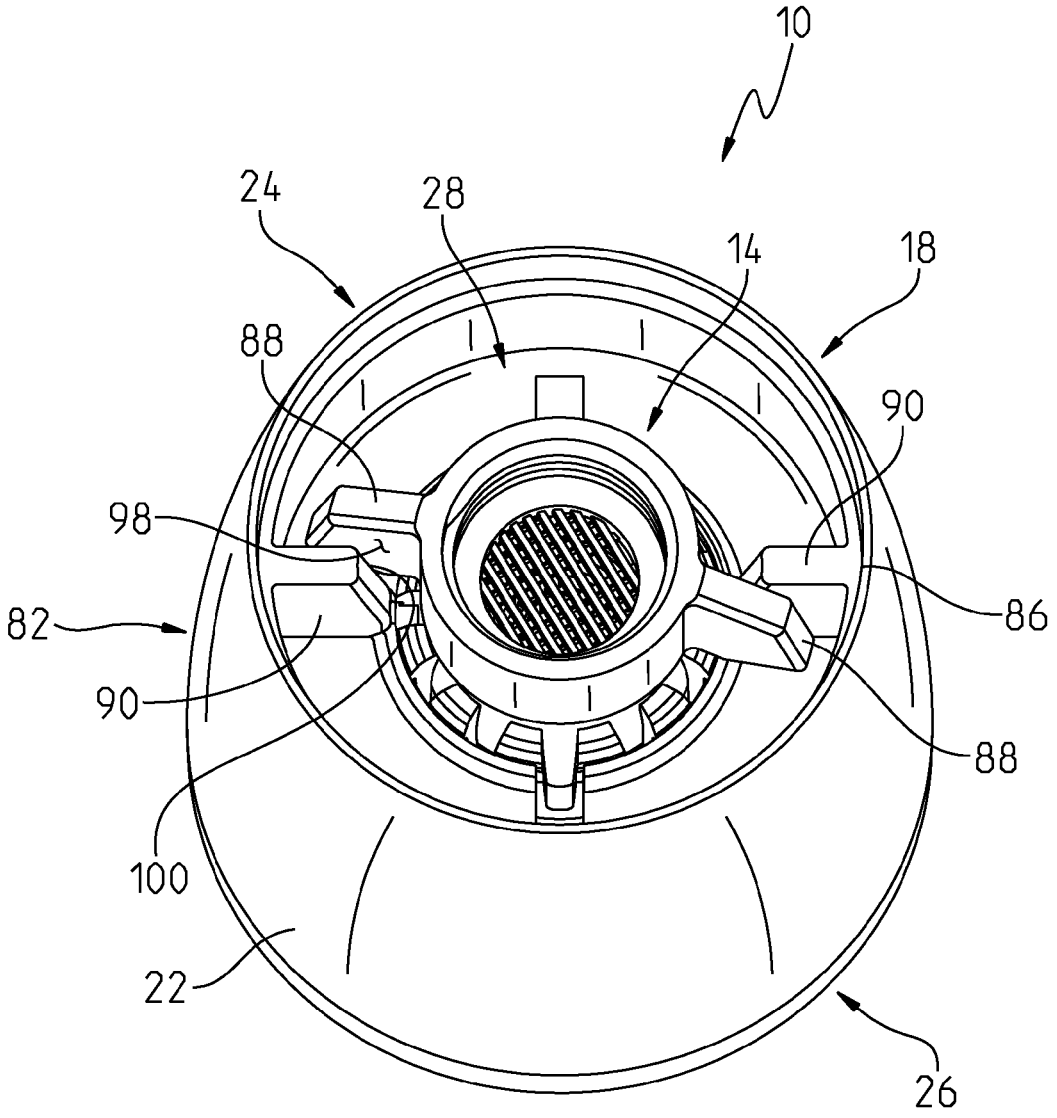
FIG. 8 is a rear perspective view of the showerhead of FIG. 1, showing the rotational stop in a loosening mode.

FIG. 8 illustrates the rotational stop 82 in a second or loosening mode of operation. In this mode, the outer shell 18 has been rotated in a clockwise direction such that a second surface 98 of at least one of the blades 88 contacts a second surface 100 of at least one of the ribs 90. As such, additional or further rotation of the outer shell 18 will cause similar clockwise rotation of the fluid connector 30. This additional rotation of the stem 34 will cause an untightening or loosening of the fluid connector 30 relative to the shower arm 12.

Figure 6:
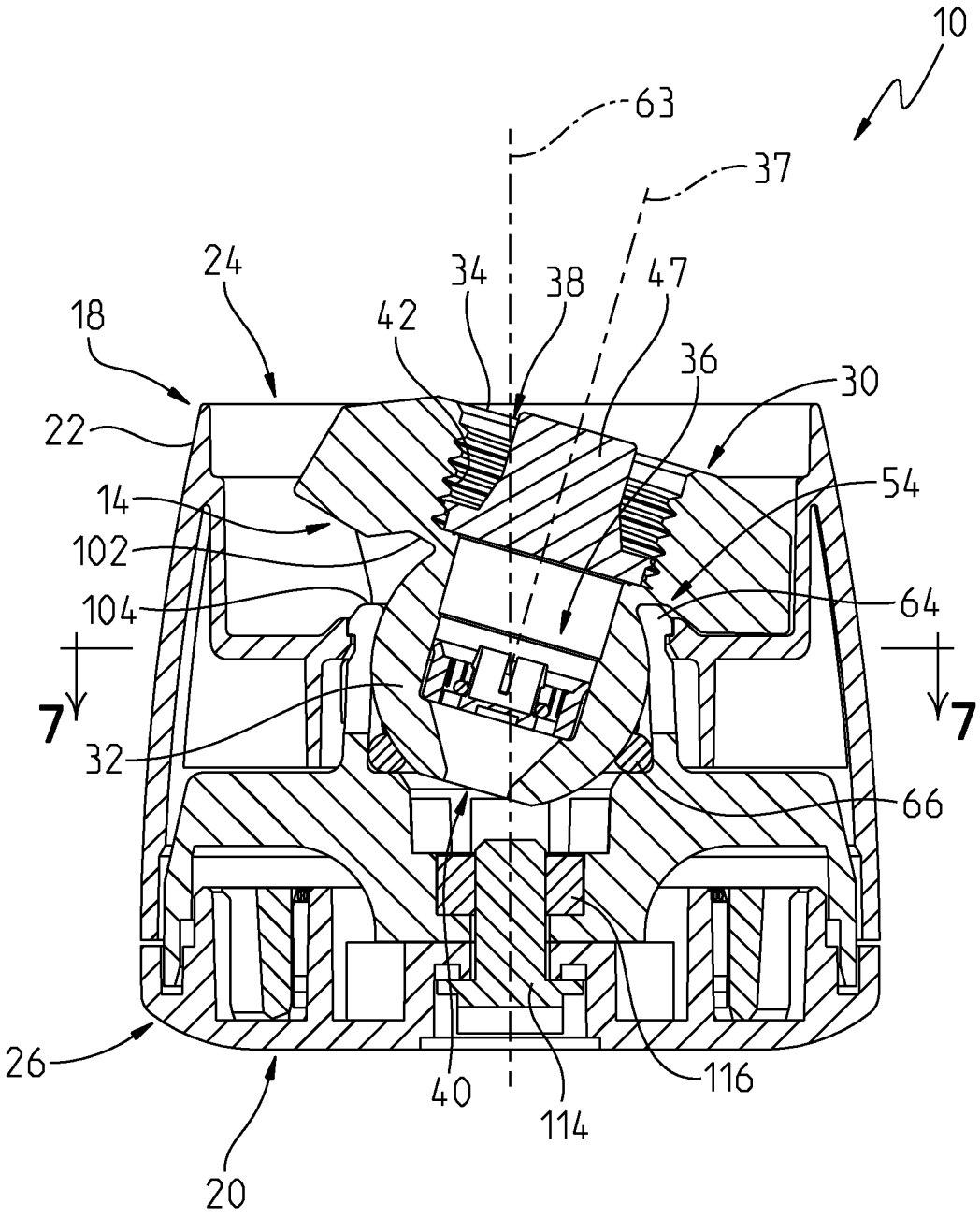
FIG. 6 is a longitudinal cross-section view of the showerhead of FIG. 1.

With further reference to FIG. 6, the fluid connector 30 is shown fully pivoted off of center. More particularly, the stem 34 is shown pivoted about axis 60 such that longitudinal axis 37 is angled relative to longitudinal axis 67 of the shell 18. A shoulder 102 on the fluid connector 30 interacts with a top surface 104 of the coupler 54 to act as an adjustment limit when the connector 30 is fully adjusted off of center.

In one illustrative embodiment, multi-dimensional fluidic devices 110 may be assembled into housings 112 formed in the sprayface 20. While multi-dimensional fluidic devices 110 are shown in the illustrative embodiment, it should be appreciated that other fluid spray devices may be substituted therefor, such as conventional spray nozzles. Illustrative fluidic devices 110 are configured to produce a stream or jet of water moving in at least two dimensions. Such fluidic devices 110 may comprise any number of combinations of two-dimensional (2D) fluidic devices and/or three-dimensional (3D) fluidic devices.

2D fluidic devices are configured to produce fan of water within a plane by oscillating a water or stream about a center axis. 3D fluid devices are pair of interacting fans of water. In general, each 3D fluidic device comprises a pair of adjacent 2D fluidic devices disposed parallel to each other. Moreover, the 3D effect may be produced by combining two 2D fluidic devices that have initially converging fans of water that upon contact approximate a center plane reflect outwardly away from each other. Illustratively, the fans of water are formed by oscillating water streams about a respective center axis within initially converging planes. At the convergence point, the fans of water reflect away from each other in diverging planes, thereby moving in a direction away from the center plane.

In the illustrative embodiment, five (5) circumferentially spaced 3D fluidic devices 110 are supported in the housings 112 of the sprayface 20. It should be appreciated that the number and orientation of fluidic devices within the sprayface 20 may vary. Various arrangements of fluidic devices or chips within a showerhead are further detailed in PCT International Patent Application Publication No. WO2012/050894 to Masco Corporation of Indiana, the disclosure of which is expressly incorporated by reference herein.

The sprayface 20 is illustratively coupled to the receiver 16 in a conventional manner. While a bolt 114 and a nut 116 are shown in the illustrative embodiment, other coupling means may be substituted therefor, such as ultrasonic welding, hot plate welding, adhesives, or snaps. A seal (not shown) may be positioned intermediate the sprayface 20 and the receiver 16.

Figure 11:
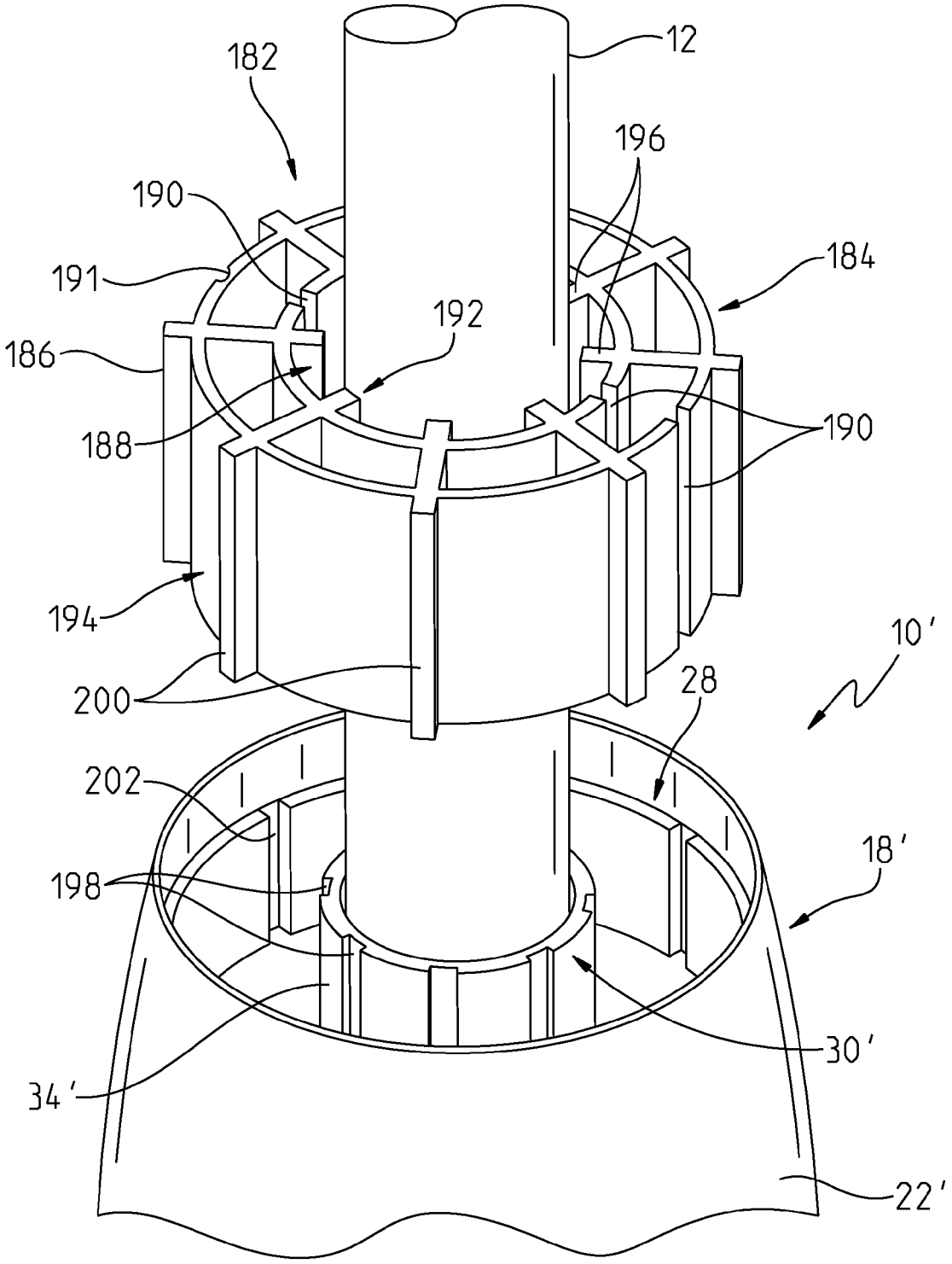
FIG. 11 is a exploded perspective view of a further illustrative embodiment rotational stop of the present disclosure.
Figure 12:
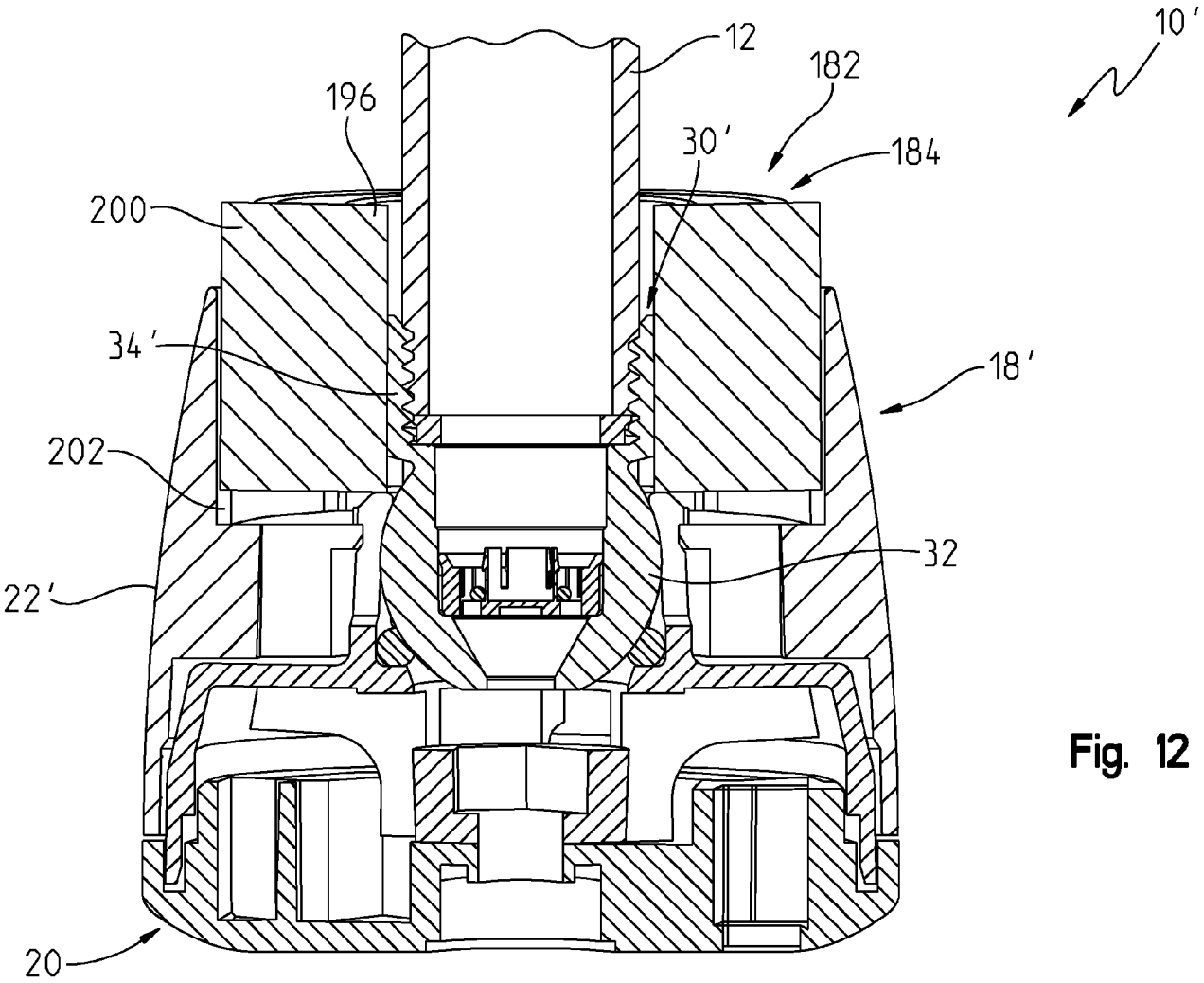
FIG. 12 is a longitudinal cross-sectional view showing interaction between the tool of FIG. 11, the outer shell and the fluid connector.

With reference now to FIGS. 11 and 12, a further illustrative drive coupling or rotational stop 182 is shown as including a removable tool 184 which is preinstalled between the fluid connector 30' and the outer shell 18'. The tool 184 illustratively includes a body 186 defining a central opening 188 configured to receive the stem 34' of the fluid connector 30'. A slot 190 and hinge 191 are formed in the body 186 to permit assembly and disassembly of the tool 184 from the shower arm 12.

The tool 184 illustratively includes an inner engagement member 192 configured to releasably engage the stem 34', and an outer engagement member 194 configured to releasably engage the outer shell 18'. Illustratively, the inner engagement member 192 includes a plurality of circumferentially spaced inner tabs or ribs 196 extending radially inwardly into engagement with slots 198 supported by the stem 34'. The outer engagement member 194 illustratively includes a plurality of circumferentially spaced outer ribs or tabs 200 extending radially outwardly into engagement with slots 202 supported by the side wall 22' of the outer shell 18'. As such, when the tool 184 is positioned intermediate the side wall 22' of the outer shell 18' and the stem 34' of the fluid connector 30', the shell 18' and the fluid connector 30' remain rotationally fixed relative to each other as the showerhead 10' is threaded onto the shower arm 12. After installation, the tool 184 may be lifted out of the showerhead opening 28 and removed from the shower arm 12 by spreading it open via the slot 190 and the hinge 191. The tool 184 may be molded from a polymer, such as acrylonitrile butadiene styrene (ABS).

As may be appreciated, the showerhead 10, 10' may be assembled without the use of a handtool (e.g., wrench) or plumbers tape. The shell 18, 18' of the showerhead 10, 10' also hides the fluid connector 30, 30' from sight when installed on the shower arm 12.

Although the invention has been described in detail with reference to certain preferred embodiments, variations and modifications exist within the spirit and scope of the invention as described and defined in the following claims.

The invention claimed is:

1. A showerhead comprising:

a fluid connector including a ball having an outlet and a stem having an inlet, a fluid passageway extending along a longitudinal axis between the inlet and the outlet;

an inner housing defining a ball joint socket receiving the ball for pivoting movement about a pair of orthogonal axes;

an outer shell including a side wall extending between an inlet end and an outlet end, and an opening defined at the inlet end, wherein the stem of the fluid connector is recessed within the opening of the outer shell a rotational stop operably coupled between the fluid connector and the outer shell, the rotational stop configured to limit relative rotation about the longitudinal axis between the fluid connector and the outer shell;

the rotational stop including an inner engagement member supported by the stem of the fluid connector, and an outer engagement member supported by the outer shell;

the inner engagement member including a blade extending radially outwardly from the stem of the fluid connector and having opposing first and second surfaces, and the outer engagement member including a rib extending radially inwardly from the side wall of the outer shell and having opposing first and second surfaces; and wherein the rotational stop includes a tightening mode of operation, a loosening mode of operation and limited rotational movement between the tightening mode of operation and the loosening mode of operation, the tightening mode of operation defined when the outer shell is rotated counterclockwise such that the first surface of the blade engages the first surface of the rib, and the loosening mode of operation defined when the outer shell is rotated clockwise such that the second surface of the blade contacts the second surface of the rib.

2. The showerhead of claim 1, wherein the rotational stop is positioned within the opening of the outer shell.

3. The showerhead of claim 1, further comprising a snap coupling securing the inner housing to the outer shell.

4. The showerhead of claim 1, further comprising a first o-ring seal positioned intermediate the ball of the fluid connector and the inner housing.

5. The showerhead of claim 1, further comprising a sprayface supported at the outlet end of the outer shell and in fluid communication with the fluid connector, and a plurality of multi-dimensional fluidic devices supported by the sprayface, the multi-dimensional fluidic devices configured to produce a fan of water within a plane by oscillating a stream of water about a center axis.

6. The showerhead of claim 5, wherein the multi-dimensional fluidic devices comprise circumferentially spaced three-dimensional fluidic devices, the three-dimensional fluidic devices configured to produce converging fans of water.

7. A showerhead comprising:

a fluid connector including a ball and a stem, the stem including threads to couple with threads on a shower arm;

a ball joint socket receiving the ball for pivoting movement about a pair of orthogonal axes;

an outer shell receiving the ball joint socket;

a rotational stop including an inner engagement member supported by the stem of the fluid connector, and an outer engagement member supported by the outer shell, the inner engagement member configured to contact the outer engagement member to limit relative rotation between the fluid connector and the outer shell;

the outer shell including a side wall extending between an inlet end and an outlet end, and an opening defined at the inlet end, wherein the stem of the fluid connector is recessed within the opening of the outer shell, the inner engagement member being received within the opening of the outer shell;

the inner engagement member including a blade extending radially outwardly from the stem of the fluid connector and having opposing first and second surfaces, and the outer engagement member including a rib extending radially inwardly from the side wall of the outer shell and having opposing first and second surfaces; and wherein the rotational stop includes a tightening mode of operation, a loosening mode of operation and limited rotational movement between the tightening mode of operation and the loosening mode of operation, the tightening mode of operation defined when the outer shell is rotated counterclockwise such that the first surface of the blade engages the first surface of the rib, and the loosening mode of operation defined when the outer shell is rotated clockwise such that the second surface of the blade contacts the second surface of the rib.

8. The showerhead of claim 7, further comprising an inner housing received within the outer shell and defining the ball joint socket.

9. The showerhead of claim 8, further comprising a first o-ring seal positioned intermediate the ball of the fluid connector and the inner housing.

10. The showerhead of claim 7, further comprising a sprayface supported by the outer shell and in fluid communication with the fluid connector, and a plurality of multi-dimensional fluidic devices supported by the sprayface, the multi-dimensional fluidic devices configured to produce a fan of water within a plane by oscillating a stream of water about a center axis.

11. The showerhead of claim 10, wherein the multi-dimensional fluidic devices comprise circumferentially spaced three-dimensional fluidic devices, the three-dimensional fluidic devices configured to produce converging fans of water.

* * * * *